US010965051B2

(12) United States Patent
Ito

(10) Patent No.: US 10,965,051 B2
(45) Date of Patent: Mar. 30, 2021

(54) CONNECTOR TERMINAL AND CONNECTOR FOR EASIER INSERTION OF A TERMINAL INTO A HOUSING

(71) Applicant: PANASONIC INTELLECTUAL PROPERTY MANAGEMENT CO., LTD., Osaka (JP)

(72) Inventor: Chikara Ito, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/394,866

(22) Filed: Apr. 25, 2019

(65) Prior Publication Data

US 2019/0334270 A1 Oct. 31, 2019

(30) Foreign Application Priority Data

Apr. 27, 2018 (JP) ..... JP2018-087705

(51) Int. Cl.

| | |
|---|---|
| ***H01R 13/40*** | (2006.01) |
| ***H01R 13/11*** | (2006.01) |
| ***H01R 13/04*** | (2006.01) |
| ***H01R 13/41*** | (2006.01) |

(52) U.S. Cl.
CPC ..... *H01R 13/114* (2013.01); *H01R 13/04* (2013.01); *H01R 13/41* (2013.01)

(58) Field of Classification Search
CPC ..... H01R 13/642; H01R 13/64; H01R 13/114
USPC ..... 439/825, 733.1
See application file for complete search history.

(56) References Cited

U.S. PATENT DOCUMENTS

| | | | | |
|---|---|---|---|---|
| 3,601,775 A * | 8/1971 | Longenecker | ..... | H01R 12/721 439/636 |
| 4,498,725 A * | 2/1985 | Bright | ..... | H01R 13/193 439/342 |
| 5,035,654 A * | 7/1991 | Endo | ..... | H01R 13/642 439/679 |

(Continued)

FOREIGN PATENT DOCUMENTS

| | | | | |
|---|---|---|---|---|
| EP | 308068 A1 * | 3/1989 | ..... | H01R 13/11 |
| JP | 2016-110994 A | 6/2016 | | |

OTHER PUBLICATIONS

U.S. Appl. No. 16/394,808 to Chikara Ito, filed Apr. 25, 2019.
U.S. Appl. No. 16/394,761 to Chikara Ito, filed Apr. 25, 2019.
U.S. Appl. No. 16/394,713 to Chikara Ito, filed Apr. 25, 2019.

*Primary Examiner* — Hae Moon Hyeon
(74) *Attorney, Agent, or Firm* — Greenblum & Bernstein, P.L.C.

(57) ABSTRACT

A connector includes a housing and a terminal held in the housing and to be mounted on a mounting member. The terminal includes a main body part inserted into a space formed in the housing and a mounting part provided continuously from the main body part and to be mounted on the mounting member. The main body part includes a bottom wall and a side wall provided continuously from the bottom wall. A groove is formed in the space. A tip of the side wall is inserted into the groove, and the groove guides insertion of the main body part into the space. The space includes an insertion opening opened toward the outside of the housing and an insertion main cavity which communicates with the insertion opening and in which to house the main body part of the terminal. The groove is formed in the insertion main cavity.

5 Claims, 11 Drawing Sheets

(56) References Cited

U.S. PATENT DOCUMENTS

| | | | | | |
|---|---|---|---|---|---|
| 5,334,053 | A * | 8/1994 | Noschese | H01R 13/112 | 439/682 |
| 5,549,480 | A * | 8/1996 | Cheng | H01R 13/631 | 439/79 |
| 6,830,471 | B2 * | 12/2004 | Okita | H01R 13/193 | 439/342 |
| 6,848,950 | B2 * | 2/2005 | Allison | H01R 12/75 | 439/682 |
| 7,204,728 | B2 * | 4/2007 | Noro | H01R 13/115 | 439/752.5 |
| 7,658,654 | B2 * | 2/2010 | Ohyama | H01R 13/114 | 439/752 |
| 10,193,255 | B2 * | 1/2019 | Ito | H01R 12/7005 | |
| 2009/0149087 | A1 * | 6/2009 | Ohyama | H01R 13/114 | 439/842 |
| 2017/0324179 | A1 * | 11/2017 | Ito | H01R 12/7005 | |
| 2018/0034185 | A1 * | 2/2018 | Nagasaka | H01R 13/642 | |
| 2019/0334265 | A1 * | 10/2019 | Ito | H01R 13/41 | |
| 2019/0334286 | A1 * | 10/2019 | Ito | H01R 13/42 | |
| 2019/0334287 | A1 * | 10/2019 | Ito | H01R 13/42 | |

* cited by examiner

CONNECTOR TERMINAL AND CONNECTOR FOR EASIER INSERTION OF A TERMINAL INTO A HOUSING

CROSS REFERENCE TO RELATED APPLICATIONS

This application is based upon and claims the benefit of priority from prior Japanese Patent Application P2018-087705 filed on Apr. 27, 2018; the entire contents of which are incorporated by reference herein.

BACKGROUND OF THE INVENTION

The present disclosure relates to a connector terminal and a connector.

There has heretofore been known a connector including a housing and a terminal housed in a space formed in the housing and are to come into conduction with a terminal of an opposing connector, as disclosed in Japanese Patent Application Publication No. 2016-110994 (hereinafter referred to as Patent Literature 1).

SUMMARY OF THE INVENTION

Although Patent Literature 1 discloses that the terminal is inserted into the space formed in the housing, it is preferable that the terminal be more easily inserted into the space formed in the housing.

Therefore, it is an object of the present disclosure to achieve a connector terminal and a connector which enable easier insertion of the terminal into a housing.

A connector according to the present disclosure includes a housing and a terminal held in the housing and to be mounted on a mounting member. The terminal includes a main body part inserted into a space formed in the housing and a mounting part provided continuously from the main body part and to be mounted on the mounting member. The main body part includes a bottom wall and a side wall provided continuously from the bottom wall. A groove is formed in the space. The groove guides insertion of the main body part into the space with a tip of the side wall inserted into the groove. The space includes an insertion opening opened toward the outside of the housing and an insertion main cavity which communicates with the insertion opening and in which to house the main body part of the terminal. The groove is formed in the insertion main cavity.

A connector terminal according to the present disclosure includes a main body part to be inserted into a space formed in a housing; and a mounting part provided continuously from the main body part and to be mounted on a mounting member. The main body part includes a bottom wall and a pair of side walls provided continuously both ends of the bottom wall in a width direction. One of the pair of side walls has an extension wall formed therein, which protrudes, more than the other side wall, in an insertion direction of the main body part into the space.

According to the present disclosure, a connector terminal and a connector which enable easier insertion into a housing can be achieved.

DESCRIPTION OF THE EMBODIMENTS

With reference to the drawings, an embodiment of the present disclosure is described in detail below. Note that the following description is given of a plug connector 1 mounted on a cable 1A and a receptacle connector 2 mounted on a circuit board 2A.

Also, the following description is given assuming that a direction perpendicular to (normal to) a mounting surface of a mounting member in a state where each of the connectors is mounted on the mounting member is a top-bottom direction (Z direction) of the connector. Moreover, description is given assuming that a direction in which terminals housed in a housing of each connector are arranged is a width direction (Y direction) and a direction in which the terminals are inserted into the housing of each connector is a front-rear direction (X direction).

Furthermore, the top side in a state where the connector mounted on the mounting member is located on the upper side of the mounting surface is defined as the top of the top-bottom direction, while the side on which the connectors face each other when fitted together is defined as the front of the front-rear direction.

[Configuration Example of Connector Set]

Figure 1:
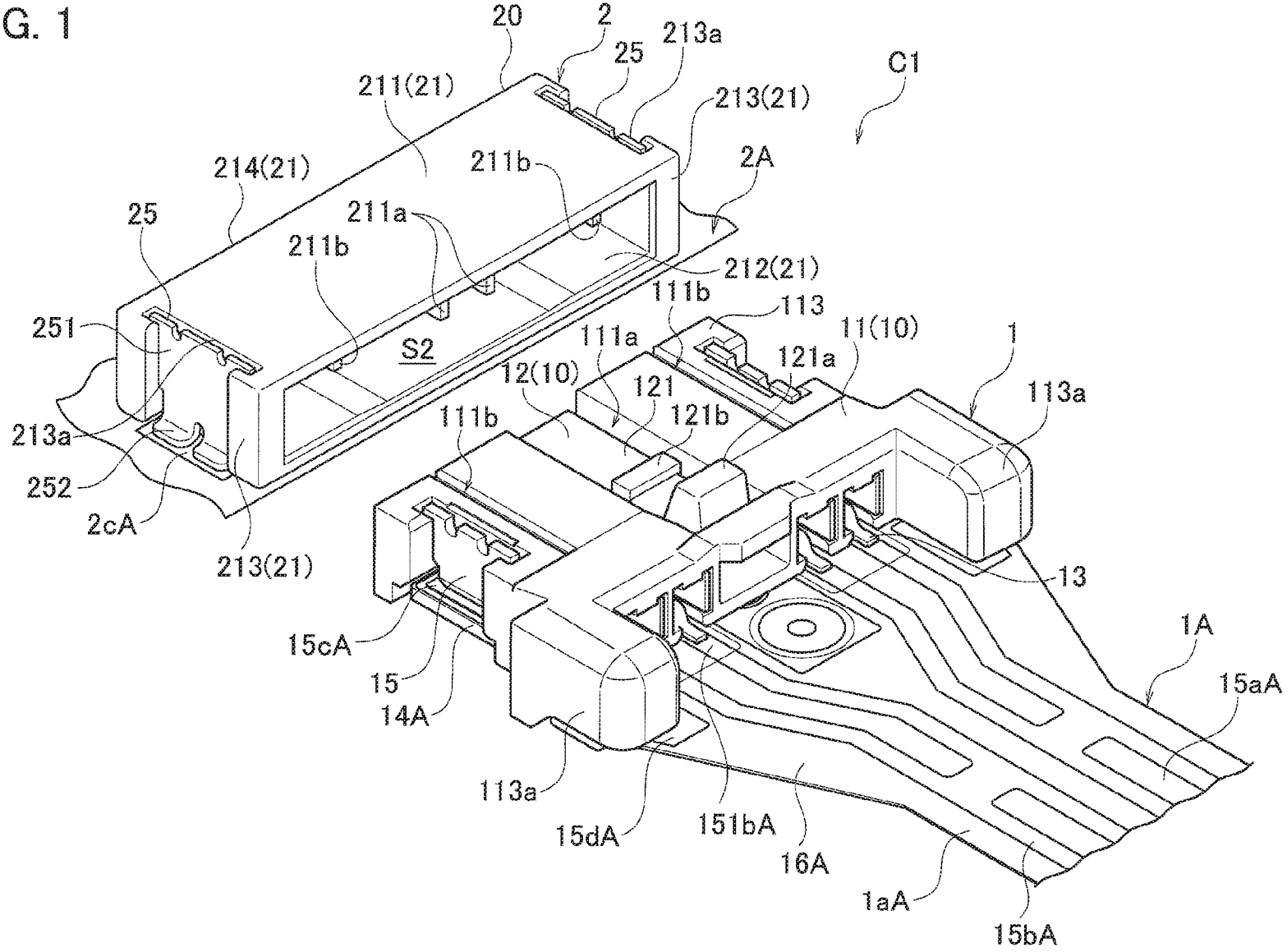
FIG. 1 is an exploded perspective view showing an example of a connector set including a plug connector mounted on a cable and a receptacle connector mounted on a mounting member.
Figure 2:
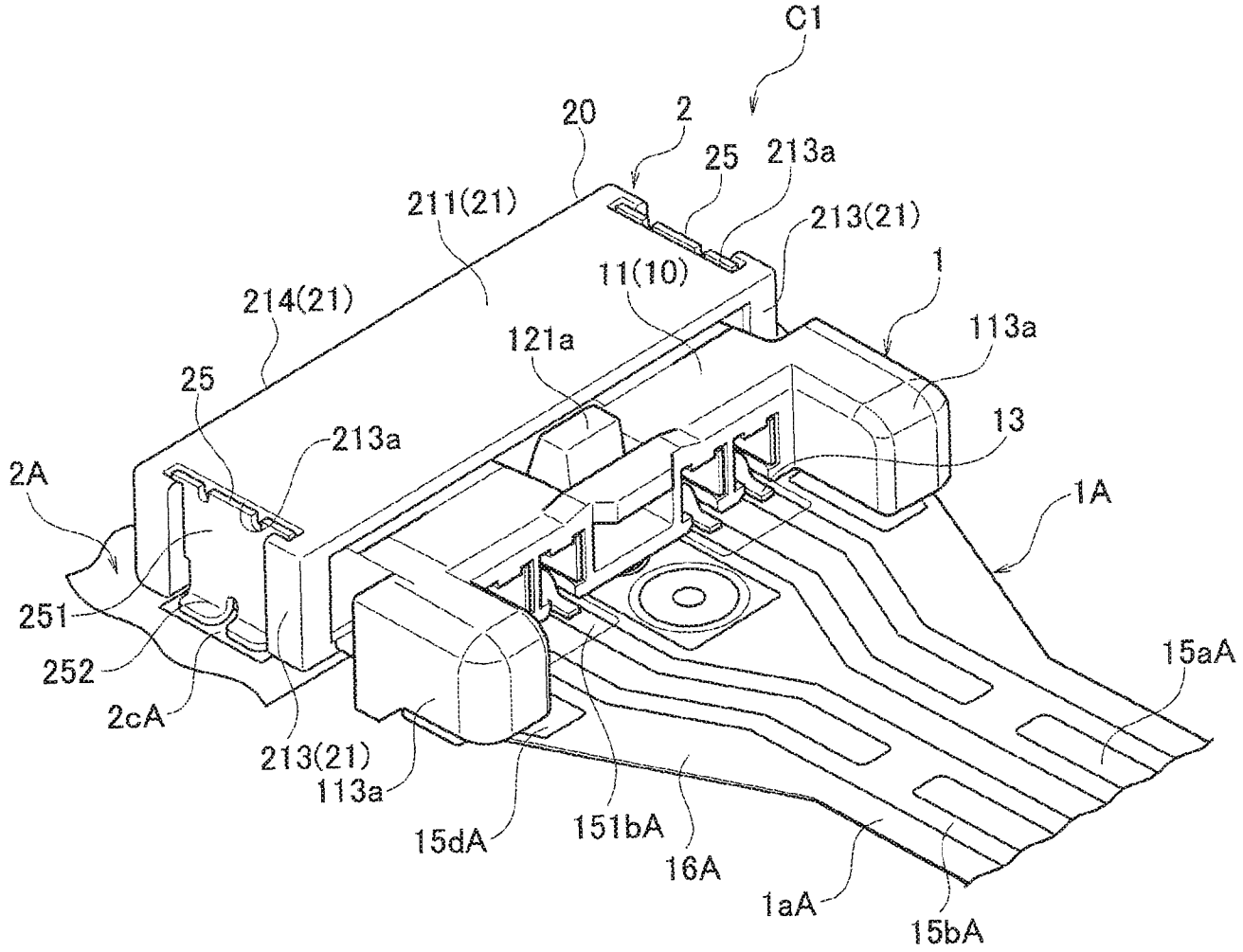
FIG. 2 is a perspective view showing an example of the connector set in a state where the plug connector mounted on the cable and the receptacle connector mounted on the mounting member are fitted together.
Figure 3A:
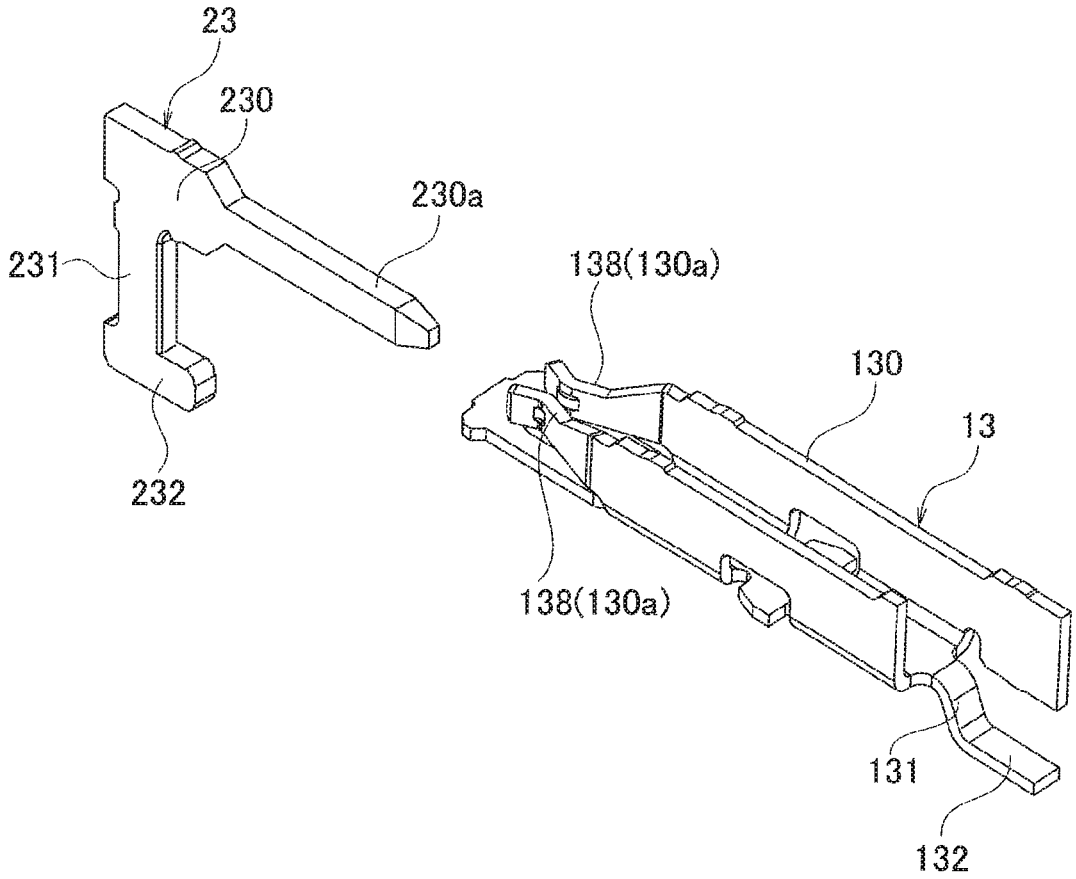
FIG. 3A is a perspective view and FIG. 3B is a plan view showing a terminal on the plug connector side and a terminal on the receptacle connector side in the connector set shown as an example, FIG. 3A showing a state where the terminal on the plug connector side and the terminal on the receptacle connector side are not in contact with each other and FIG. 3B showing a state where the terminal on the plug connector side and the terminal on the receptacle connector side are in contact with each other.

The plug connector (connector) 1 according to this embodiment is used for a connector set C1 shown in FIGS. 1 to 3, and the like.

The connector set C1 includes a receptacle connector 2 to which the plug connector 1 described above is fitted, as shown in FIG. 1 and FIG. 2.

In this embodiment, the plug connector 1 is formed to be mountable on the cable (mounting member: connecting member) 1A such as a Flexible Printed Circuit (FPC) and a Flat Flexible Cable (FFC). More specifically, the plug connector 1 is configured to be mounted on the cable 1A by electrically connecting (mounting) a plug terminal (terminal) 13 included in the plug connector 1 to a conductor part 151*b*A of the cable 1A.

Meanwhile, the receptacle connector 2 is formed to be mountable on the circuit board (mounting member) 2A. More specifically, the receptacle connector 2 is configured to be mounted on the circuit board 2A by electrically connecting (mounting) a receptacle terminal 23 included in the receptacle connector 2 to a conductor part (not shown) of the circuit board 2A.

Thus, the connector set C1 electrically connects the cable 1A to the circuit board 2A by fitting the plug connector 1 into the receptacle connector 2 to achieve conduction between the plug terminal 13 and the receptacle terminal 23 (see FIG. 2 and FIG. 3).

[Configuration Example of Cable 1A]

Figure 5:
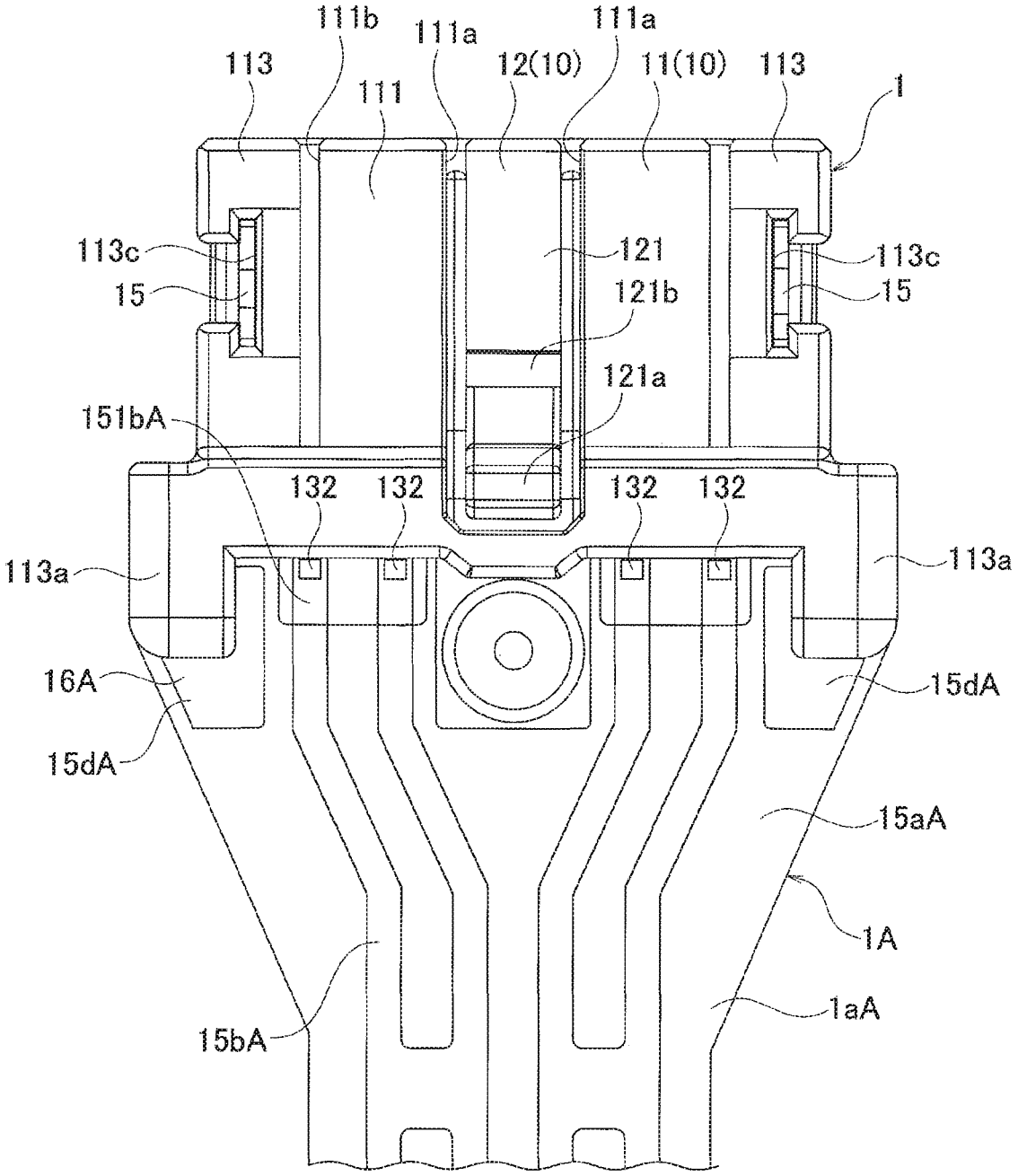
FIG. 5 is a plan view showing a state where the plug connector included in the connector set shown as an example is mounted on the cable.
Figure 6:
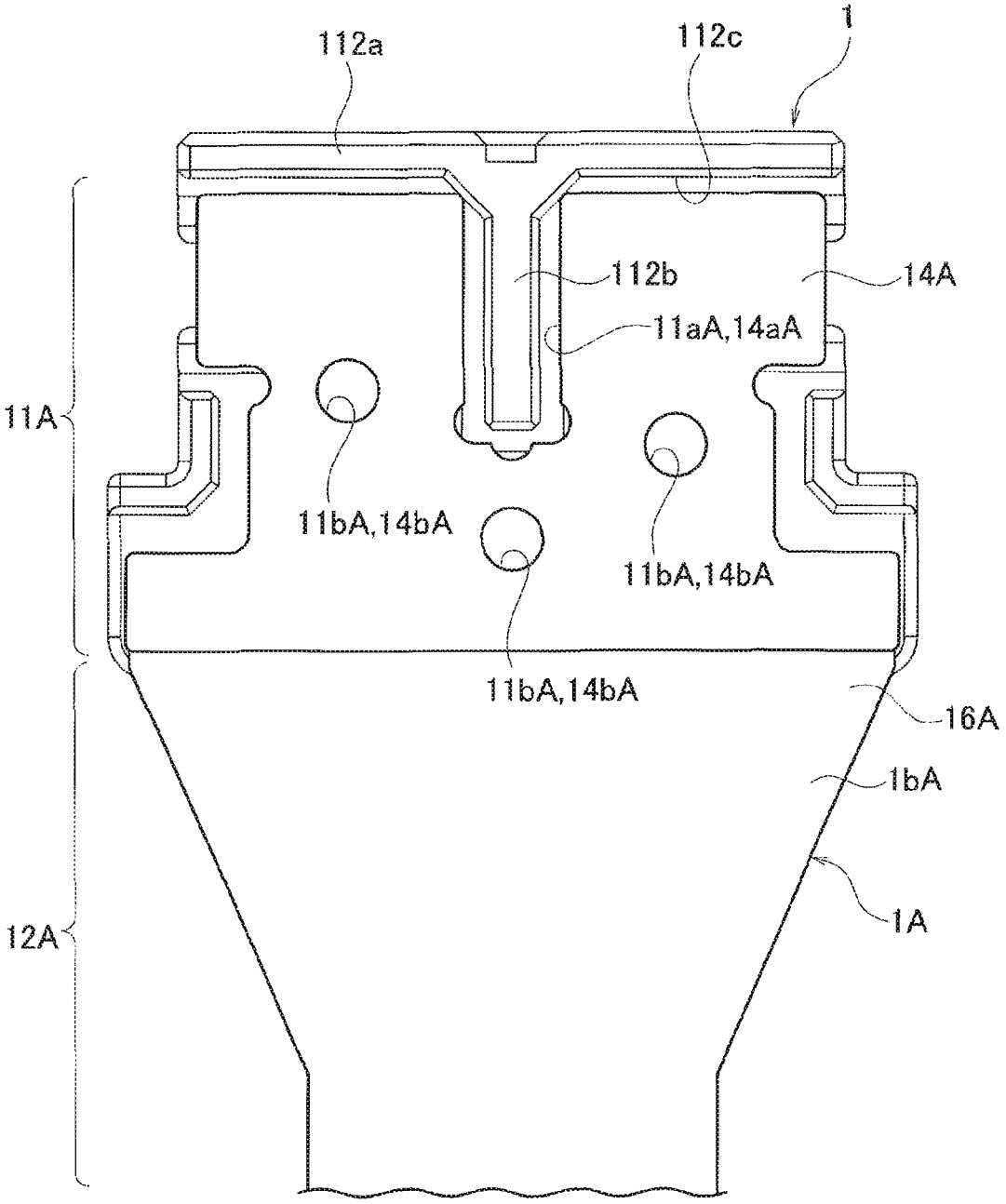
FIG. 6 is a reverse side view showing a state where the plug connector included in the connector set shown as an example is mounted on the cable.
Figure 7A:
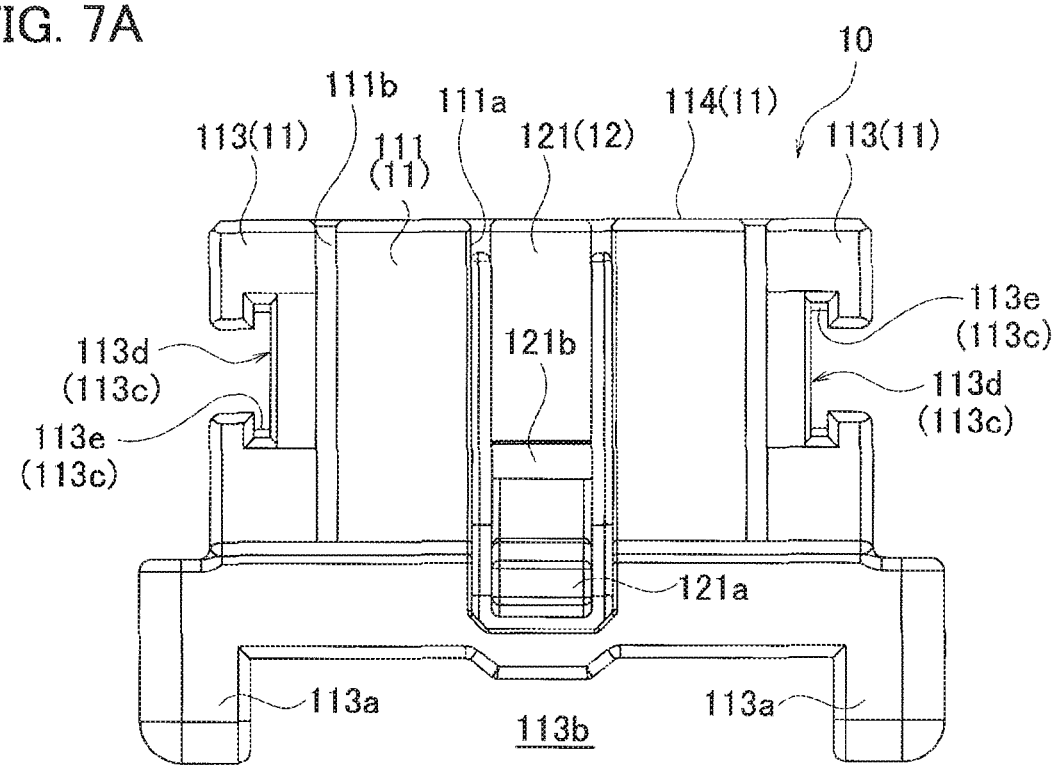
FIG. 7A is a plan view and FIG. 7B is a reverse side view showing a plug housing included in the plug connector.
Figure 7B:
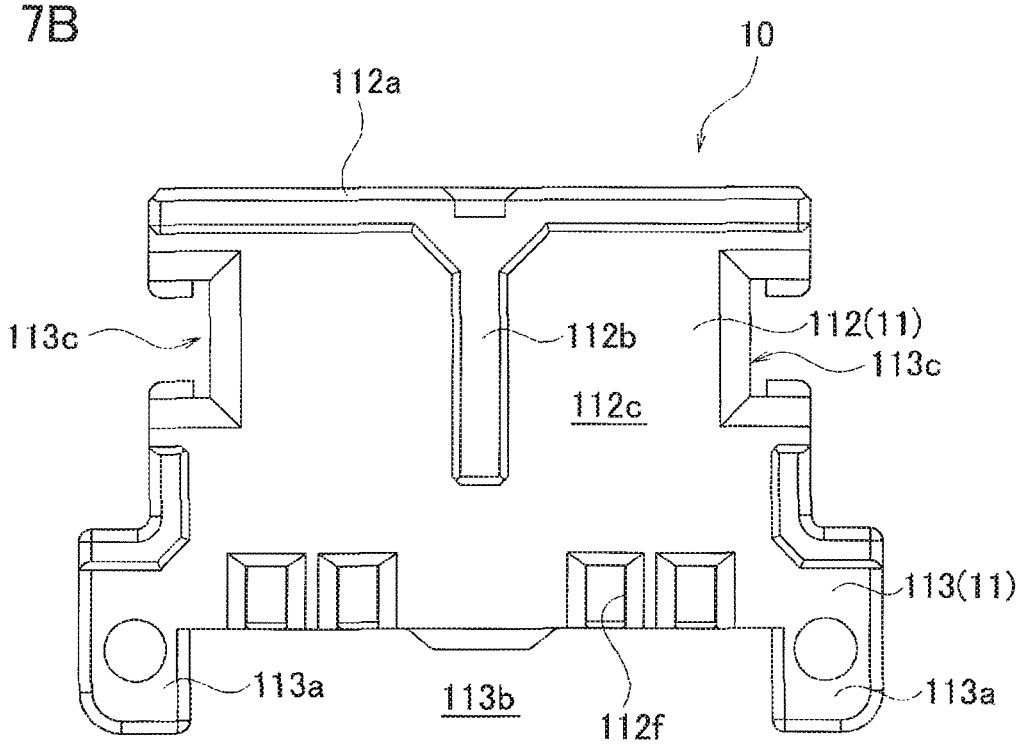
Figure 8A:
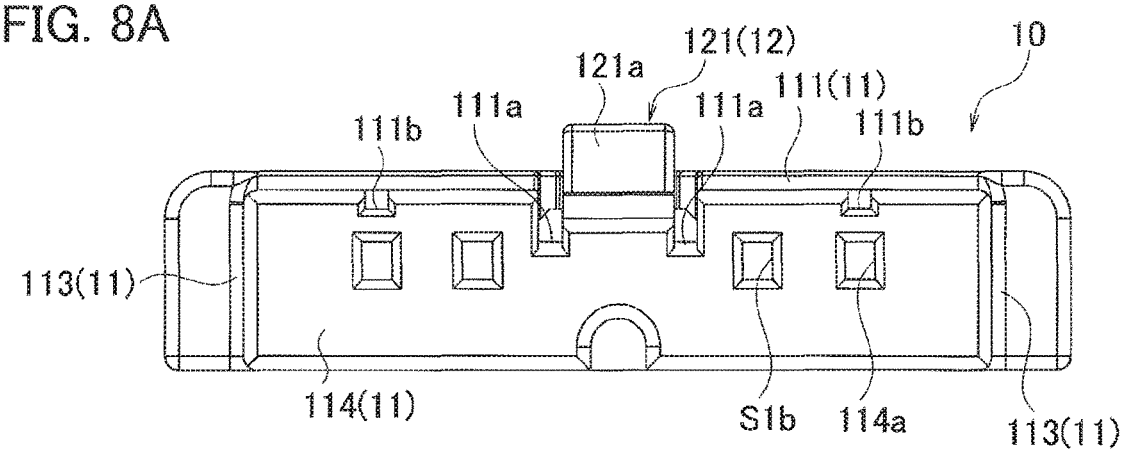
FIG. 8A is a front view.
Figure 8B:
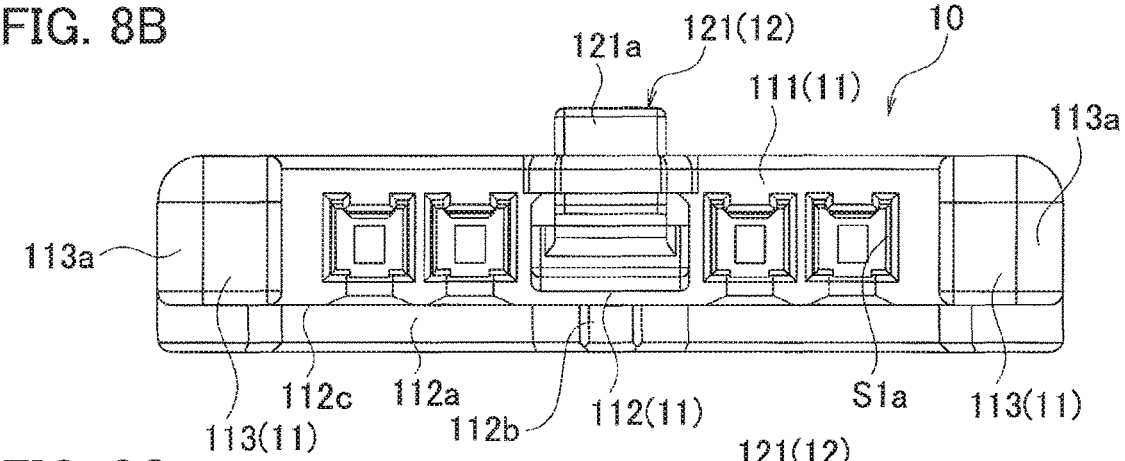
FIG. 8B is a back view.
Figure 8C:
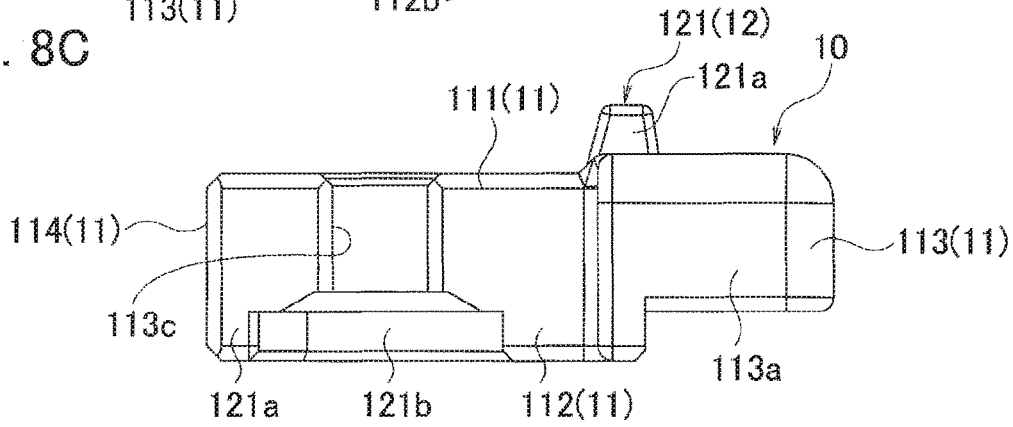
FIG. 8C is a side view.
Figure 8D:
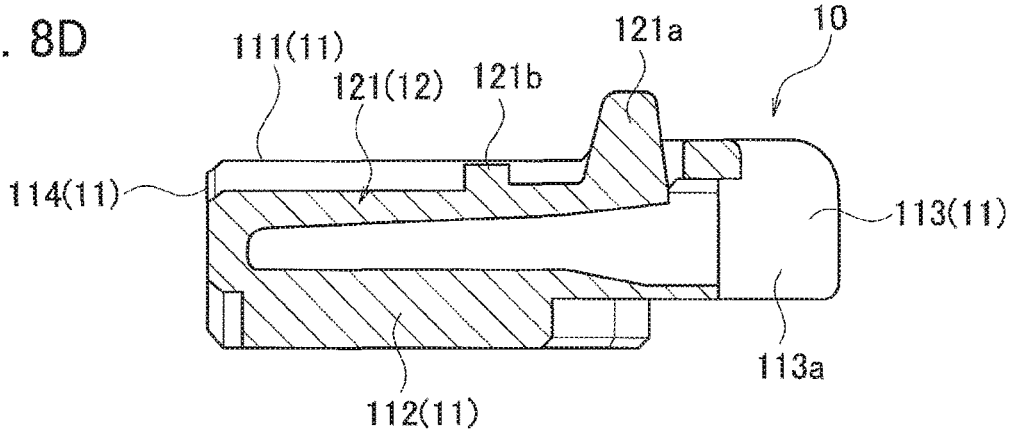
FIG. 8D is a sectional side view showing the plug housing included in the plug connector.
Figures 9A, 9B, 9C, 9D, 9E, 9F:
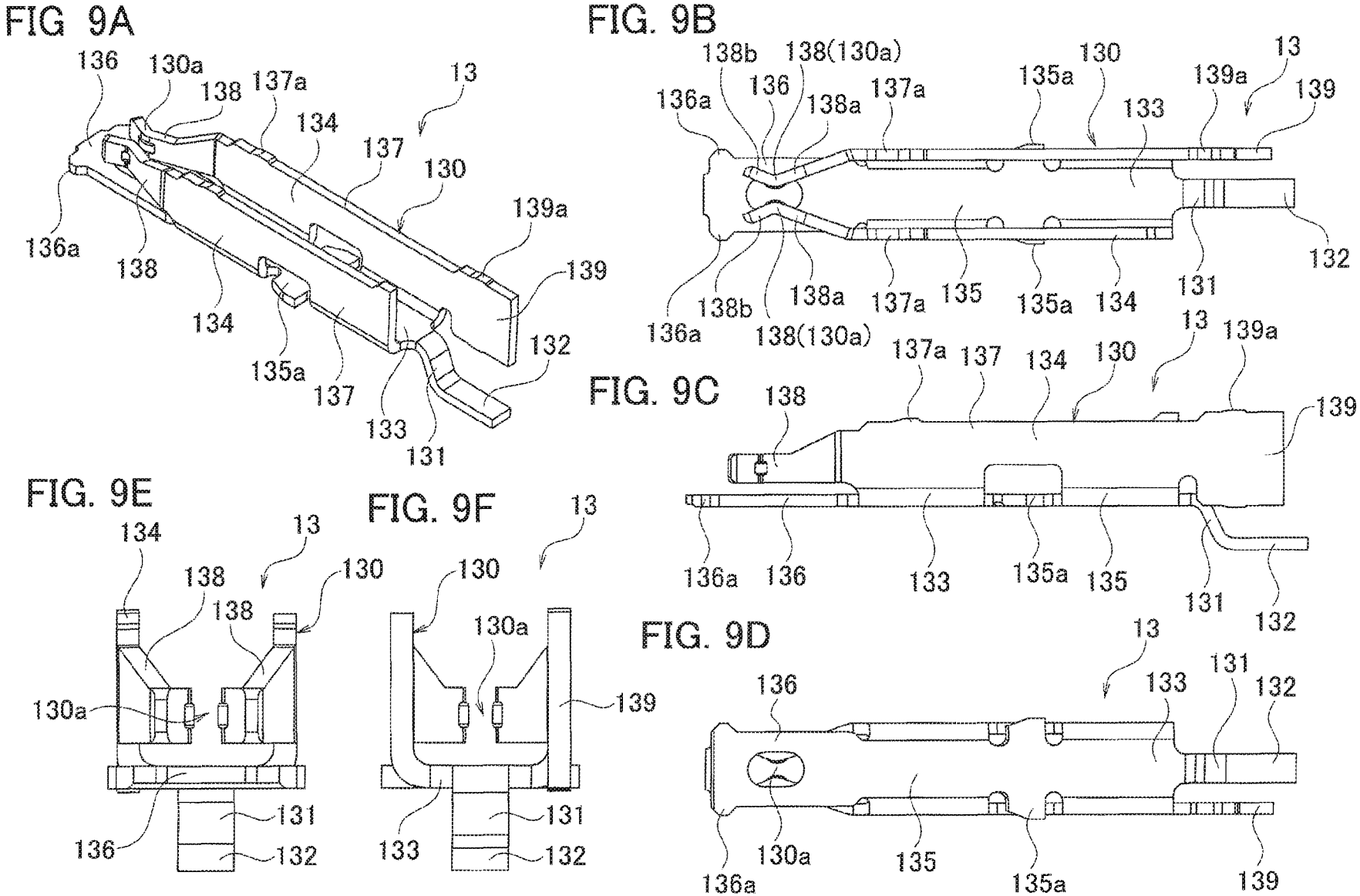
FIG. 9A is a perspective view.
FIG. 9B is a plan view.
FIG. 9C is a side view.
FIG. 9D is a reverse side view.
FIG. 9E is a front view.
FIG. 9F is a back view showing the first terminal included in the plug connector.

Next, with reference mainly to FIG. 5 and FIG. 6, description is given of a configuration example of the cable 1A on which the plug connector 1 is mounted.

The cable 1A has a sheet shape (flat plate shape) with a top surface (front surface: one side) 1*a*A and a rear surface (back surface: the other side) 1*b*A. The top surface 1*a*A serves as a mounting surface to mount the plug connector 1. The cable 1A is flexible and thus can be bent (curved) in a cable thickness direction.

This cable 1A includes a connection region 11A used for connection with the plug connector 1 and an extension region 12A in which a conductor layer 15*b*A extends for wiring with another circuit.

In this embodiment, the cable 1A is formed such that the connection region 11A is positioned at one end side of the extension region 12A. In a state where the plug connector 1 having the connection region 11A connected thereto is fitted into the receptacle connector 2, the extension region 12A is positioned on the opposite side of the receptacle connector 2.

Moreover, the cable 1A has a multilayer structure, including a support layer 15*a*A and the conductor layer 15*b*A supported by the support layer 15*a*A. The support layer 15*a*A is formed of a plurality of insulator films to cover the conductor layer 15*b*A. On the other hand, the conductor layer 15*b*A is formed of conductor films printed on the insulator films included in the support layer 15*a*A, which are a plurality of wiring patterns corresponding to a plurality of plug terminals 13 to be described later, respectively.

On the upper surface of the connection region 11A, a plurality of conductor parts 151*b*A are formed, which are the conductor layer 15*b*A exposed from the support layer 15*a*A. The plurality of conductor parts 151*b*A are formed so as to be arranged at a predetermined pitch in the width direction (Y direction).

Such a structure can be formed, for example, by printing the plurality of conductor films on the support layer 15*a*A to form the conductor layer 15*b*A and then covering the conductor layer 15*b*A with another support layer 15*a*A. In this event, another support layer 15*a*A is provided so as not to cover the tip of the conductive layer 15*b*A. Thus, the cable 1A having the tip of the conductive layer 15*b*A exposed on one side (top side of the top-bottom direction) is formed.

Note that a method for forming the cable 1A is not limited to the above method, but various other methods can be used to form the cable 1A.

On the upper surface of the connection region 11A, fixing parts 15*c*A are also formed to fax holding brackets 15 to be described later in the plug connector 1. In this embodiment, the cable 1A includes wide parts 16A extending on either side in the width direction (Y direction) of the plurality of conductor layers 15*b*A arranged in the width direction (Y direction), and a pair of fixing parts 15*c*A are formed on the tip side of the respective wide parts 16A (on the front side of the front-rear direction). Moreover, on the rear side in the front-rear direction of the respective wide parts 16A, fixing parts 15*d*A are formed to fix a plug housing 10 of the plug connector 1. These fixing parts 15*c*A and 15*d*A can be formed, for example, in the same manner as the conductor layers 15*b*A in a printing process for the conductor layers 15*b*A.

Moreover, in this embodiment, a slit 11*a*A that is elongated in the front-rear direction (X direction) and opened forward is formed in the connection region 11A of the cable 1A. On either side, in the width direction (Y direction), of the slit 11*a*A and on the rear side, in the front-rear direction, thereof in the connection region 11A, through-holes 11*b*A are formed penetrating in the cable thickness direction (top-bottom direction; Z direction).

Furthermore, in this embodiment, the cable 1A includes a reinforcing plate 14A (see FIG. 1 and FIG. 2). This reinforcing plate 14A is formed using glass epoxy resin, stainless steel, or the like, and is configured to reinforce the connection region 11A of the cable 1A by sandwiching the connection region 11A of the cable 1A between the reinforcing plate 14A and the plug connector 1.

In this embodiment, the reinforcing plate 14A has a shape corresponding to the shape of the connection region 11A of the cable 1A. More specifically, a contour shape of the reinforcing plate 14A in the plan view (state viewed, along the mounting surface 1Aa) is approximately the same as that of the connection region 11A. Therefore, a slit 14*a*A that is elongated in the front-rear direction (X direction) and opened forward and through-holes 14*b*A penetrating in the cable thickness direction (top-bottom direction; Z direction) are formed in the reinforcing plate 14A. Then, the reinforcing plate 14A is attached to the rear surface side of the connection region 11A with an adhesive or the like in a state where the slit 11*a*A and the slit 14*a*A communicate with each other and the through-holes 11*b*A and the through-holes 14*b*A communicate with each other.

In this event, it is preferable that the entire conductor part 151*b*A overlaps with the reinforcing plate 14A in the plan view (state viewed along the mounting surface 1Aa). In this way, the entire conductor part 151*b*A is supported by the reinforcing plate 14A, and thus can be prevented from bending in the top-bottom direction (Z direction) or warping in the width direction (Y direction).

[Configuration Example of Plug Connector 1]

Next, with reference to FIG. 4 and FIGS. 7 to 11, description is given of a configuration example of the plug connector 1.

Figure 4:
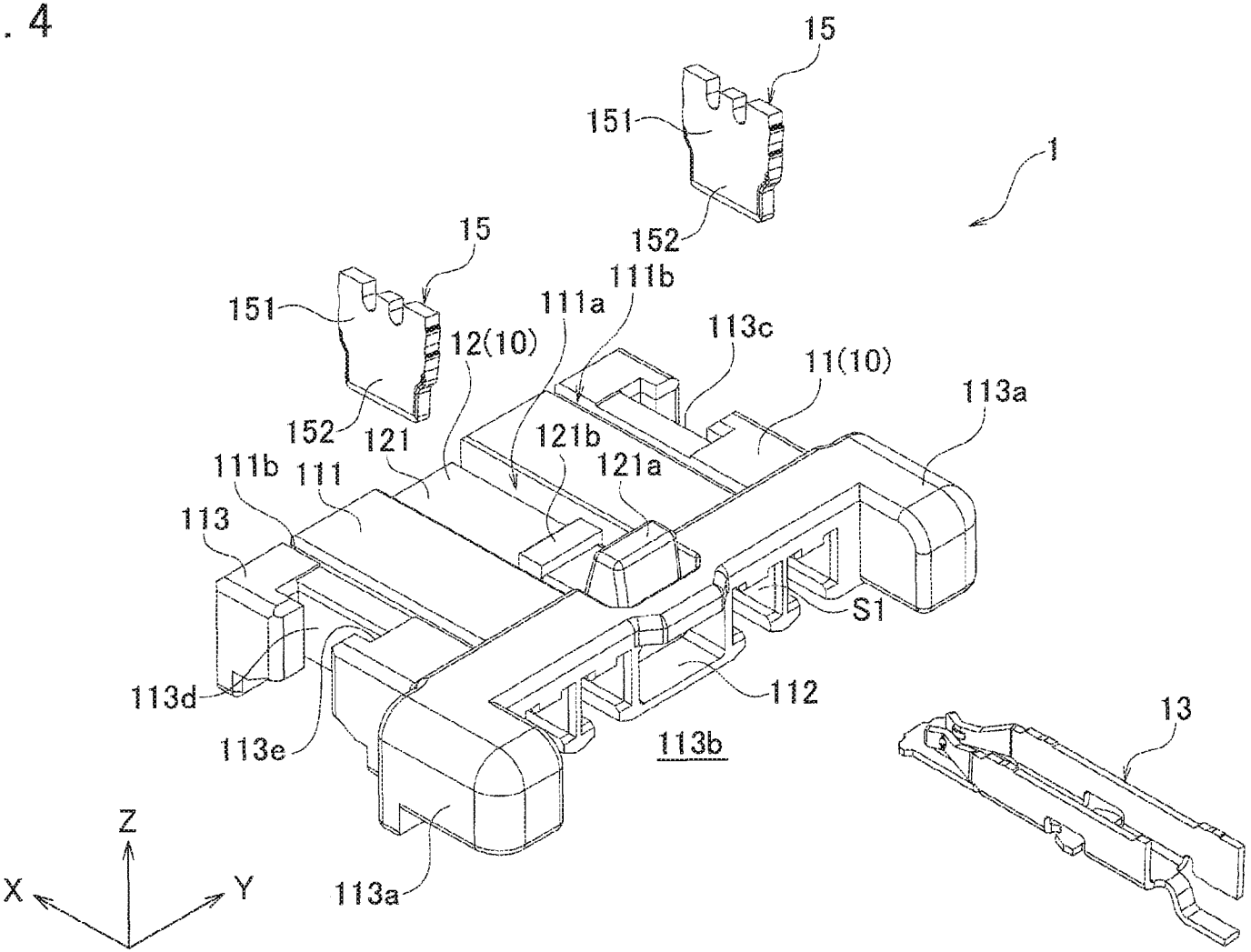
FIG. 4 is an exploded perspective view showing the plug connector included in the connector set shown as an example.

As shown in FIG. 4, the plug connector 1 includes a plug housing (housing) 10, a plug terminal (terminal: connector terminal) 13 held by the plug housing 10, and the holding brackets 15 held by the plug housing 10.

The plug connector 1 is configured to be mounted on the cable 1A as the mounting member by mounting the plug terminal 13 held by the plug housing 10 on the conductor part 151*b*A of the cable 1A disposed outside the plug housing 10. Note that the plug terminal 13 is mounted on the conductor part 151*b*A by soldering or the like. The holding brackets 15 are fixed to the fixing parts 15*c*A of the cable 1A by soldering or the like, in a state where the holding brackets 15 are held by the plug housing 10, to fix the plug housing 10 to the cable 1A.

The plug housing 10 includes a rigid housing main body 11, and can be formed, for example, using an insulating resin material.

The plug housing 10 also includes a lock part 12 to hold the plug housing 10 and a receptacle housing 20 of the receptacle connector 2 in their fitted state or to release the fitted state.

The housing main body 11 includes a top wall 111, a bottom wall 112, a pair of side walls 113 connecting both ends, in the width direction (Y direction), of the top wall 111 and the bottom wall 112, and a front wall 114 provided continuously from front ends of the top wall 111, the bottom wall 112, and the side walls 113, 113.

The lock part 12 is formed in the middle, in the width direction, of the top wall 111. To be more specific, the lock part 12 includes a lever part 121 that is provided continuously from a central portion, in the width direction, of the front end of the bottom wall 112 and extends rearward. This lever part 121 has its rear side capable of moving in the top-bottom direction relative to the housing main body 11. The lever part 121 has an operation part 121*a* formed at its rear end to operate the lever part 121, and also has an engagement protrusion 121*b* formed in its central portion in the front-rear direction to engage with an engaged part (not shown) formed in the receptacle connector 2.

In this embodiment, when the plug housing 10 and the receptacle housing 20 of the receptacle connector 2 are fitted together, the housings of the respective connectors can be locked together (maintained in the fitted state) by the engagement protrusion 121*b* engaging with the engaged part. Then, the fitted state of the housings of the respective connectors can be released by lowering the operation part 121*a* of the lever part 121 to move downward the lever part 121 as well as the engagement protrusion 121*b*, thus releasing the engagement with the engaged part.

Furthermore, there is a gap between the lock part 12 and the top wall 111. This gap serves as a guide groove 111*a* to guide the fitting between the plug housing 10 and the receptacle housing 20 of the receptacle connector 2. Note that the top wall 111 also has a guide groove 111*b* formed therein to guide the fitting between the plug housing 10 and the receptacle housing 20 of the receptacle connector 2.

Moreover, at the front end of the lower side (rear surface side) of the bottom wall 112, a protrusion 112*a* extending in the width direction and a protrusion 112*b* extending rearward in the front-rear direction from the center of the protrusion 112*a* in the width direction are formed so as to protrude downward. These protrusions 112*a* and 112*b* are formed in the bottom wall 112 such that the protrusion amount is not less than the sum of the thickness of the cable 1A and the thickness of the reinforcing plate 14A.

By forming such protrusions 112*a* and 112*b* in the bottom wall 112, a recess part 112*c* is formed in the lower surface of the bottom wall 112. When the plug connector 1 is mounted on the cable 1A, the connection region 11A having the reinforcing plate 14A attached thereto is housed in the recess part 112*c* (see FIG. 6).

As described above, in this embodiment, the plug housing 10 includes a pair of walls (top wall 111 and bottom wall 112) facing each other in the housing thickness direction (top-bottom direction: Z direction). The recess part 112*c* to house the connection region 11A of the cable 1A is formed in the bottom wall 112 that is one of the pair of walls (top wall 111 and bottom wall 112). More specifically, the plug housing 10 has a receiving part (recess part 112*c*) to receive the cable (mounting member) 1A in the wall (bottom wall 112) on one side in the housing thickness direction (top-bottom direction).

Note that the protrusion 112*b* is formed so as to correspond to the slit 11*a*A and the slit 14*a*A, and a positional shift in the width direction of the cable 1A is suppressed by inserting the protrusion 112*b* into the slit 11*a*A and the slit 14*a*A. Moreover, the protrusion 112*a* suppresses a forward shift in position of the cable 1A.

The housing main body 11 includes a plurality of dividing walls 116 provided continuously from the top wall 111, the bottom wall 112, and the front wall 114. These dividing walls 116 partition the space formed in the plug housing 10 into a plurality of spaces. Also, the front wall 114 has through-holes 114*a* formed therein, which communicate with the plurality of spaces partitioned by the top wall 111, the bottom wall 112, and the dividing walls 116. Thus, in this embodiment, a plurality of spaces S1 penetrating in the front-rear direction are formed in the housing main body 11. Then, the plug terminals 13 are press-fitted (inserted) into the spaces S1 penetrating in the front-rear direction, respectively.

In this embodiment, the plug terminals 13 are each configured to be press-fitted (inserted) forward from an opening at the rear end side of the space S1. This opening at the rear end side of the space S1 serves as an insertion opening (insertion slot) S1*a*. Also, an opening at the front end side of the space S1 is formed to be smaller than the insertion opening S1*a* so as to prevent the plug terminal 13 from falling off. More specifically, forward movement of the plug terminal 13 press-fitted (inserted) from the insertion opening S1*a* is restricted by the front wall 114. Note that the opening at the front end side of the space S1 serves as an introduction port S1*b* for introducing a contact portion 230*a* of the receptacle terminal 23 of the receptacle connector 2 to be described later into the space S1. This introduction port S1*b* has its peripheral portion formed into a tapered shape so as to facilitate introduction of the contact portion of the receptacle terminal.

An insertion main cavity S1*c* is formed between the insertion opening S1*a* and the introduction port S1*b*, and the main body part 130 of the plug terminal 13 is housed in the insertion main cavity S1*c*. Thus, in this embodiment, the space S1 includes: the insertion opening S1*a* opened toward the outside (rear side) of the plug housing 10; and the insertion main cavity S1*c* which communicates with the insertion opening S1*a* and in which to house the main body part 130 of the plug terminal 13.

Furthermore, in this embodiment, a groove 111*c* opened rearward and downward is formed in the lower part of the top wall 111 so as to communicate with the space S1. This groove 111*c* guides press-fitting (insertion) of the plug terminal 13 into the space S1 by insertion of an upper end (tip) of a side wall 134 of the plug terminal 13 to be described later into the groove.

The groove 111*c* described above is formed in the insertion main cavity S1*c* of the space S1. Furthermore, the insertion opening S1*a* also has a second groove 111*d* formed therein to guide press-fitting (insertion) of the plug terminal 13 into the space S1.

Figure 10A:
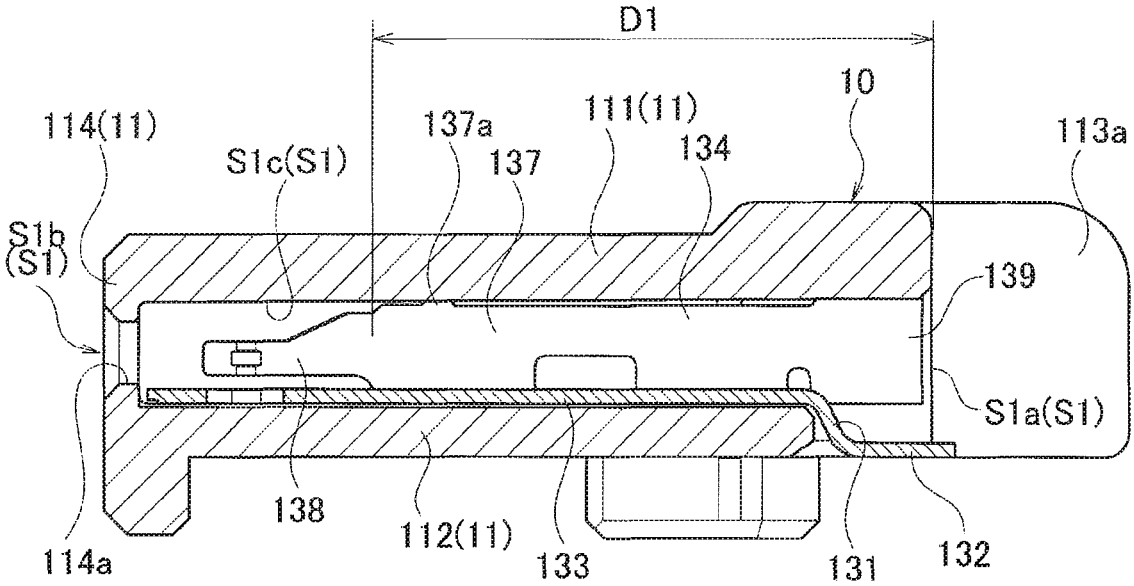
FIG. 10A and FIG. 10B are sectional side views showing a space formed in the plug housing, FIG. 10A showing a state where the terminal is inserted into the space and FIG. 10B showing a groove formed in the space.
Figure 10B:
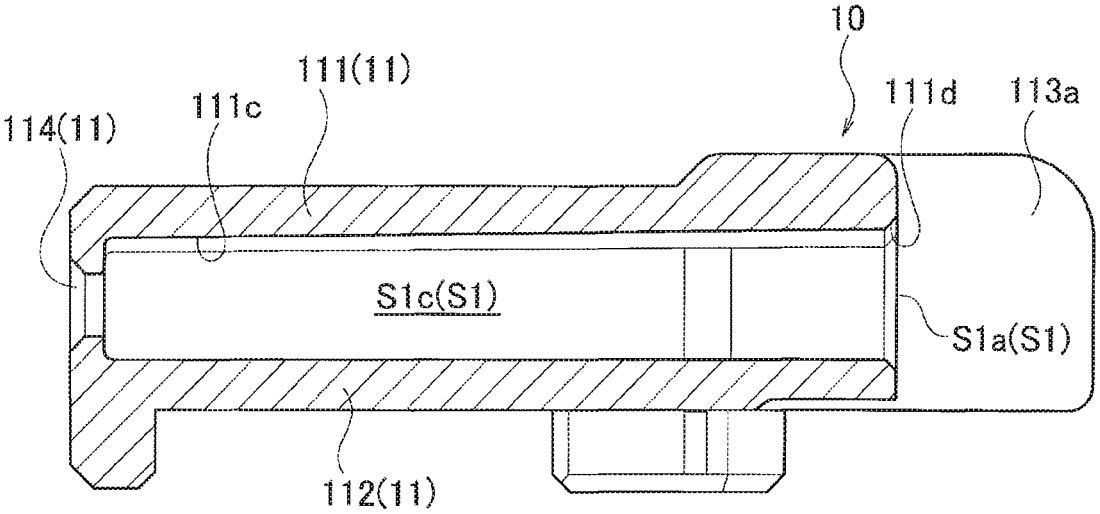
Figure 11:
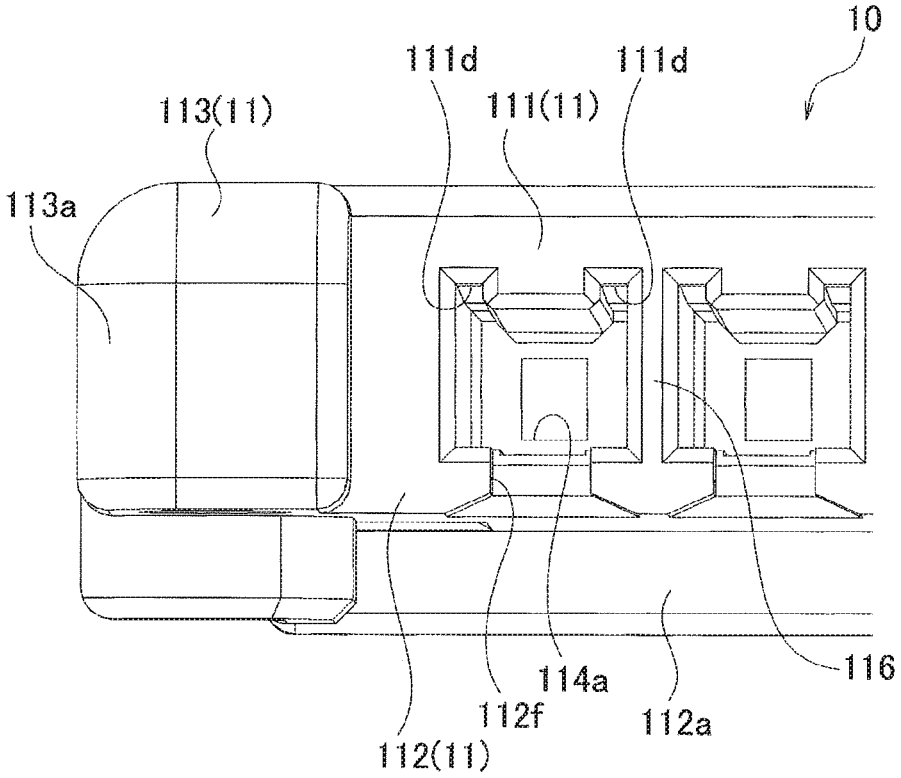
FIG. 11 is an enlarged perspective view showing the groove formed in the space.

In this embodiment, as shown in FIG. 11, the grooves 111*c* are formed on both sides of the space S1 in the width direction so as to extend from the insertion opening S1*a* to the front wall 114 (see FIG. 10B). More specifically, the second grooves 111*d* communicate with the grooves 111*c*. The grooves 111*c* extend beyond the center of the space S1 to the inner side (front side) of the space S1 in the insertion direction (X direction). Moreover, the length of the grooves 111*c* in the insertion direction (X direction) is not shorter than a distance D1 by which the plug terminal 13 moves between the start and end of insertion of the upper end of the side wall 134 into the groove 111*c* (see FIG. 10A).

Therefore, a portion of the upper end of the side wall 134 first inserted into the groove 111*c* stays inside the groove 111*c* until the press-fitting (insertion) of the plug terminal 13 into the space S1 is completed after the start of the insertion into the groove 111*c*.

Note that the groove 111*c* is formed to have a groove width (length in the Y direction) slightly larger than the thickness of the side wall 134.

Moreover, a recess part 112*f* that is opened downward and rearward and extends in the front-rear direction is formed at the rear end part of the bottom wall 112. This recess part 112*f* can suppress the mounting piece (mounting part) 132 of the plug terminal 13 in the press-fitted (inserted) state from interfering with the plug housing 10. Thus, the mounting piece (mounting part) 132 can be prevented from protruding too much outward from the plug housing 10 in the state where the press-fitting (insertion) of the plug terminal 13 into the space S1 is completed.

Furthermore, extension parts 113*a*, 113*a* extending rearward are formed on the pair of side walls 113, 113, respectively. A region where the extension parts 113*a*, 113*a* face each other serves as a recess part 113*b* that houses the mounting piece (mounting part) 132 of the plug terminal 13.

As described above, in this embodiment, the mounting piece (mounting part) 132 of the plug terminal 13 is mounted on the conductor part 151*b*A of the cable 1A at the position closer to the front than the rear ends of the extension parts 113*a*, 113*a*. Furthermore, in this embodiment, tips (rear ends) of the extension parts 113*a*, 113*a* are fixed to the fixing parts 15*d*A of the cable 1A. In this event, the connection region 11A of the cable 1A is sandwiched between the extension parts 113*a*, 113*a* and the reinforcing plate 14A.

In this way, when the cable 1A is fanned to move away from the reinforcing plate 14A, the cable 1A and the reinforcing plate 14A can be more surely suppressed from coming off each other. Furthermore, since the mounting pieces (mounting parts) 132 of the plug terminals 13 are positioned closer to the front than the tips (rear ends) of the extension parts 113*a*, 113*a*, the mounting pieces 132 of the plug terminals 13 can be prevented from being deformed by fanning of the cable 1A. More specifically, the mounting parts between the plug terminals 13 and the cable 1A can be protected from fanning of the cable 1A.

Moreover, at the front ends of the pair of side walls 113, 113, holding bracket attachments 113*c*, 113*c* are formed, respectively, to hold the holding brackets 15.

In this embodiment, the holding bracket attachment 113*c* includes: a recess part 113*d* opened outward in the top-bottom direction and in the width direction; and slits 113*e*, 113*e* provided continuously from the inside, in the width direction, of the recess part 113*d*, into which both ends, in the front-rear direction, of a main body part 151 of the holding bracket 15 is inserted. In a state where the holding brackets 15 are held by the plug housing 10, fixing parts 152 provided continuously from lower ends of the main body parts 151 are fixed to the fixing parts 15*c*A of the cable 1A, thereby fixing the plug housing 10 to the cable 1A.

The plug terminal 13 is conductive, and the plug terminals 13 are arranged in the width direction (Y direction) of the plug housing 10. As shown in FIGS. 9A to 9F, the plug terminal 13 has a shape formed by bending a strip-shaped metal member in a strip thickness direction, and has an approximately U-shape when viewed along the insertion direction (front-rear direction; X direction) (see FIG. 9E and FIG. 9F). Such a plug terminal 13 can be formed, for example, by bending a strip-shaped metal member.

The plug terminal 13 also includes a main body part 130 to be press-fitted (inserted) into the space S1. The plug terminal 13 further includes: a leg part 131 extending from the main body part 130 toward the mounting surface 1*a*A in a state where the plug terminal 13 is mounted on the cable (the mounting member) 1A; and a mounting piece (mounting part) 132 provided continuously from the leg part 131 and to be mounted on the cable 1A.

The main body part 130 includes a bottom wall 133 and side walls 134 provided continuously from both ends, in the width direction (Y direction), of the bottom wall 133.

The bottom wall 133 includes: a bottom wall main body 135 provided continuously from the lower end of the side wall 134; and a contact protection part 136 that is provided continuously from the front end of the bottom wall main body 135 and protrudes forward. This contact protection part 136 prevents the contact part 130*a* of the plug terminal 13 from coming into contact with the housing main body 11 when the main body part 130 is press-fitted (inserted) into the space S1.

The bottom wall main body 135 and the contact protection part 136 have regulating pieces 135*a* and 136*a* formed therein, respectively, which protrude outward from both ends in the width direction (Y direction). These regulating pieces 135*a* and 136*a* prevent the main, body part 130 from being obliquely press-fitted (inserted) when the main body part 130 is press-fitted (inserted) into the space S1.

The leg part 131 is provided extending downward (toward the cable 1A: mounting member) from the rear end of the bottom wall main body 135, and the mounting piece 132 is provided continuously from the lower end of the leg part 131 so as to protrude rearward. Thus, in this embodiment, the leg part 131 is provided extending in the housing thickness direction from the main body part 130 that is press-fitted (inserted) into the space S1. These leg part 131 and mounting piece 132 are each formed into a thin plate shape (plate shape).

The side wall 134 includes: a side wall main body 137 having its lower end provided continuously from the bottom wall main body 135; and an elastically deformable contact piece 138 that is provided continuously from the front end of the side wall main body 137 and comes into contact with the contact part 230*a* of the receptacle connector 2.

The side wall main body 137 has a regulating protrusion 137*a* termed at its upper end. This regulating protrusion 137*a* prevents the main body part 130 from being lifted when press-fitted (inserted) into the space S1.

The contact piece 138 includes: an inner bent piece 138*a* provided continuously from the front end of the side wall main body 137 so as to be bent inward in the width direction; and an outer bent piece 138*b* provided continuously from the front end of the inner bent piece 138*a* so as to be bent inward in the width direction.

In this embodiment, the contact pieces 138 are provided continuously from the pair of side wall main bodies 137, 137, respectively, and are formed to be approximately line-symmetric in the plan view. More specifically, the pair of contact pieces 138, 138 include: the inner bent pieces

138*a*, 138*a* bent in a direction of getting close to each other toward the front; and the outer bent pieces 138*b*, 138*b* bent in a direction of getting away from each other toward the front.

Figure 3B:
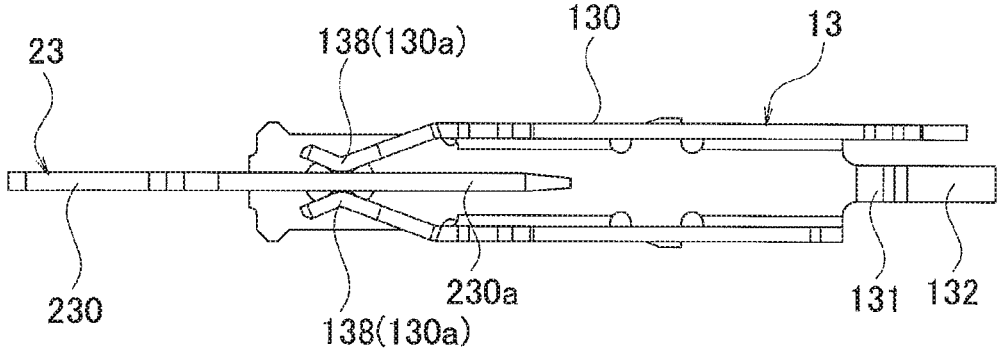

The contact part 230*a* of the receptacle connector 2 is sandwiched in a spot (connection between the inner bent piece 138*a* and the outer bent piece 138*b*) where the pair of contact pieces 138, 138 come closest to each other (see FIG. 3B). Thus, in this embodiment, the pair of contact pieces 138, 138 function as the contact part 130*a* of the plug terminal 13. Also, the pair of outer bent pieces 138*b* function as a guide part for more smoothly guiding the contact part 230*a* of the receptacle connector 2.

Furthermore, in this embodiment, an extension wall 139 protruding rearward is provided continuously from the rear end of one of the pair of side wall main bodies 137, 137, and the main body part 130 has a shape having its one side protruding rearward.

This extension wall 139 has a press-fit protrusion 139*a* formed at its upper end. The main body part 130 is press-fitted into the space S1 by sticking the press-fit protrusion 139*a* into the housing main body 11.

Here, in this embodiment, the grooves 111*c* are formed to guide the press-fitting (insertion) of the plug terminal 13 into the space S1 while the upper ends of the side walls 134 of the plug terminal 13 are inserted into the grooves. Therefore, a positional shift in the plug terminal 13 is suppressed even when the plug terminal 13 is press-fitted (inserted) into the space S1 by pressing one side wall 134 protruding rearward of the main body part 130. As a result, the plug terminal 13 can be press-fitted (inserted) more smoothly and more accurately into the space S1.

Note that, in this embodiment, when the plug terminal 13 is press-fitted (inserted) into the space S1, the upper end of the side wall main body 137 constituting a part of the side wall 134 is inserted into the groove 111*c*. Therefore, in this embodiment, the front side edge of the upper end of the side wall main body 137 is the portion of the upper end of the side wall 134 to be first inserted into the groove 111*c*.

[Configuration Example of Receptacle Connector 2]

Next, with reference to FIG. 1 and FIG. 2, description is given of a configuration example of the receptacle connector 2.

As shown in FIG. 1 and FIG. 2, the receptacle connector 2 includes a receptacle housing (housing) 20 and a receptacle terminal (terminal) 23 held by the receptacle housing 20. The receptacle connector 2 also includes holding brackets 25 held by the receptacle housing 20.

The receptacle connector 2 is configured to be mounted on the circuit board 2A as the mounting member by mounting the receptacle terminal 23 held by the receptacle housing 20 on the conductor part (not shown) of the circuit board 2A disposed outside the receptacle housing 20. Note that the receptacle terminal 23 is also mounted on the conductor part by soldering or the like. The holding brackets 25 are fixed to the fixing parts 2*c*A of the circuit board 2A by soldering or the like, in a state where the holding brackets 25 are held by the receptacle housing 20, to fix the receptacle housing 20 to the circuit board 2A.

The receptacle housing 20 includes a rigid housing main body 21, and can be formed, for example, using an insulating resin material.

The housing main body 21 includes a top wall 211, a bottom wall 212, a pair of side walls 213 connecting both ends, in the width direction (Y direction), of the top wall 211 and the bottom wall 212, and a rear wall 214 provided continuously from rear ends of the top wall 211, the bottom wall 212, and the side walls 213, 213.

The lever part 121 is housed in the middle, in the width direction, of the top wall 211. The top wall 211 has an engaged part (not shown) formed therein to engage with the engagement protrusion 121*b* of the lock part 12. On the top wall 211, guide protrusions 211*a* to be inserted into the guide grooves 111*a* and guide protrusions 211*b* to be inserted into the guide grooves 111*b* are formed.

Note that the rear wall has a plurality of spaces formed therein, which penetrate in the front-rear direction. The receptacle terminals 23 are press-fitted (inserted) into these spaces, respectively.

Moreover, the housing main body 21 has a fitting space S2 formed therein, which is opened forward (toward the plug connector 1 side). This fitting space S2 is a space into which the housing main body 11 of the plug housing 10 is to be inserted and fitted, and which is defined by the top wall 211, the bottom wall 212, the pair of side walls 213, 213, and the rear wall 214.

Moreover, the pair of side walls 213, 213 have holding bracket attachments 213*a*, 213*a* formed thereon, respectively, to hold the holding brackets 25. In a state where the holding brackets 25 are held by the receptacle housing 20, fixing pieces 252 provided continuously from lower ends of the main body parts 251 are fixed to the fixing parts 2*c*A of the circuit board 2A, thereby fixing the receptacle housing 20 to the circuit board 2A.

In this embodiment, the receptacle terminal 23 is conductive, and the receptacle terminals 23 are arranged in the width direction (Y direction) of the receptacle housing 20. As shown in FIG. 3, the receptacle terminal 23 is formed into a thin plate shape, and is press-fitted (inserted) from the rear side into the housing 20 in a state where the plate thickness direction is approximately aligned with the width direction (V direction). This receptacle terminal 23 can be formed, for example, by punching thin plate metal.

The receptacle terminal 23 also includes a main body part 230 to be press-fitted (inserted) into the rear wall 214. The receptacle terminal 23 further includes: a leg part 231 extending from the main body part 230 toward the circuit board 2A in a state where the receptacle terminal 23 is mounted on the circuit board (the mounting member) 2A; and a mounting piece (mounting part) 232 provided continuously from the leg part 231 and to be mounted on the circuit board 2A.

At the front end of the main body part 230, an approximately rod-shaped contact part 230*a* is formed so as to protrude forward. In a state where the main body part 230 is press-fitted (inserted) into the rear wall 214, the contact part 230*a* is disposed in the fitting space S2.

When the plug connector 1 described above is fitted into the receptacle connector 2 thus configured, the lock part 12 of the plug housing 10 is inserted into the receptacle housing 20, and thus the housing main body 11 is inserted into the fitting space S2.

In this event, the engagement protrusion 121*b* of the lever part 121 is pushed downward by the top wall 211 of the receptacle housing 20. When the engagement protrusion 121*b* is pushed downward by the top wall 211 in this way, the rear end part (operation part 121*a*) of the lever part 121 is elastically deformed so as to move downward, and thus the engagement protrusion 121*b* can be moved into the inner side of the fitting space S2.

Then, when the engagement protrusion 121*b* is moved into the inner side of the fitting space S2, the downward pushing of the engagement protrusion 121*b* by the top wall 211 is released, and the elastic restoring force of the lever part 121 moves the engagement protrusion 121*b* upward. The engagement protrusion 121*b* is moved upward to be engaged with the engaged part formed in the receptacle connector 2, thus allowing the plug connector 1 and the receptacle connector 2 to be locked in the fitted state.

During the course of fitting the plug connector 1 into the receptacle connector 2, the tip of the contact part 230*a* of the receptacle terminal 23 is introduced into the space S1 formed in the plug housing 10 from the introduction port S1*b* to come into contact with the contact part 130*a* of the plug terminal 13. Note that, in this embodiment, the approximately rod-shaped contact part 230*a* is inserted between the pair of contact pieces 138, 138 and sandwiched by the pair of contact pieces 138, 138 to achieve conduction between the plug terminal 13 and the receptacle terminal 23.

As described above, the plug connector 1 and the receptacle connector 2 are fitted together to achieve conduction between the plug terminal 13 and the receptacle terminal 23. Thus, the connector set C1 is formed to electrically connect the cable 1A to the circuit board 2A.

Meanwhile, in order to detach the plug connector 1 from the receptacle connector 2, the operation part 121*a* of the lever part 121 is first lowered to move the lever part 121 downward. Accordingly, the engagement protrusion 121*b* is also moved downward to release the engagement between the engagement protrusion 121*b* and the engaged part. Then, by pulling the plug connector 1 in a removal direction from the receptacle connector 2 in the state where the engagement between the engagement protrusion 121*b* and the engaged part is released, the plug connector 1 is moved in the removal direction relative to the receptacle connector 2. When the plug connector 1 is thus moved in the removal direction relative to the receptacle connector 2, the conduction between the terminals is first released, and then the fitting between the housings is released. Thus, the plug connector 1 is detached from the receptacle connector 2.

As described above, the plug connector (connector) 1 according to this embodiment includes the plug housing (housing) 10 and the plug terminal (terminal) 13 held by the plug housing 10 and to be mounted on the cable (mounting member) 1A.

The plug terminal 13 includes: the main body part 130 to be inserted into the space S1 formed in the plug housing 10; and the mounting piece (mounting part) 132 provided continuously from the main body part 130 and to be mounted on the cable 14. The main body part 130 includes the bottom wall 133 and the side walls 134 provided continuously from the bottom wall 133.

In the space S1, the grooves 111*c* are formed to guide insertion of the main body part 130 into the space S1 while the tips of the side walls 134 are inserted into the grooves. The space S1 includes: the insertion opening S1*a*opened toward the outside of the plug housing 10; and the insertion main cavity S1*c* which communicates with the insertion opening S1*a* and in which to house the main body part 130 of the plug terminal 13. The grooves 111*c* are formed in the insertion main cavity S1*c*.

This structure is capable of guiding the insertion of the main body part 130 into the space S1 on the inner side beyond the insertion opening S1*a* (front side) in the insertion direction.

Moreover, the length of the grooves 111*c* in the insertion direction (X direction) is not shorter than the distance D1 by which the main body part 130 moves between the start and end of insertion of the tip of the side wall 134.

Thus, a positional shift in the plug terminal 13 can be suppressed when the plug terminal 13 is press-fitted (inserted) into the space S1.

The grooves 111*c* extend beyond the center of the space S1 to the inner side of the space S1 in the insertion direction. Thus, the main body part 130 can be guided to near the insertion end position.

Furthermore, the insertion opening S1*a* also has the second groove 111*d* formed therein to guide insertion of the main body part 130 into the space S1. The second groove 111*d* communicates with the groove 111*c*. Thus, the main body part 130 can be guided to near the insertion end position from the insertion start position.

As described above, according to this embodiment, the plug terminal 13 can be press-fitted (inserted) more smoothly and more accurately to the press-fit (insertion) end position in the space S1.

Moreover, in this embodiment, the side walls 134 are provided continuously from the both ends, in the width direction (Y direction), of the bottom wall 133, and one of the side walls 134 has the extension wall 139 formed therein, which protrudes rearward, more than the other side wall 134, in the insertion direction (X direction) of the main body part 130 into the space S1.

When the plug terminal 13 with a long one side wall 134 is press-fitted (inserted) into the space S1, the one side wall 134 protruding rearward of the main body part 130 is generally pushed. The use of such a plug terminal 13 is likely to cause a positional shift during press-fitting (insertion) into the space S1.

However, by forming the grooves 111*c* in the space S1 to guide the insertion of the main body part 130 into the space S1, the plug terminal 13 can be more smoothly and more accurately press-fitted (inserted) into the space S1 even when the plug terminal 13 with a long one side wall 134 is used.

Thus, according to this embodiment, a positional shift in the plug terminal 13 is suppressed even when the one side wall 134 protruding rearward of the main body part 130 is pushed. As a result, the plug terminal 13 can be more smoothly and more accurately press-fitted (inserted) into the space S1.

The plug terminal (connector terminal) 13 according to this embodiment includes: the main body part 130 to be inserted into the space S1 formed in the plug housing (housing) 10; and the mounting piece (mounting part) 132 provided continuously from the main body part 130 and to be mounted on the cable (mounting member) 1A.

The main body part 130 includes the bottom wall 133 and the pair of side walls 134, 134 provided continuously from the both ends of the bottom wall 133 in the width direction.

One of the side walls 134, 134 has the extension wall 139 formed therein, which protrudes, more than the other side wall 134, in the insertion direction (X direction) of the main body part 130 into the space S1.

As described above, by inserting the plug terminal (connector terminal) 13 having the side walls 134 different in length into the space S1 formed in the plug housing (housing) 10, friction force acting on the plug terminal 13 during insertion into the space S1 can be reduced at least on the side of the shorter side wall 134. Thus, the plug terminal 13 can be more easily press-fitted (inserted) into the space S1.

Although the preferred embodiment of the present disclosure has been described above, the present disclosure is not limited to the above embodiment and modified examples thereof, but various changes can be made thereto.

Moreover, although the description has been given of the one having the plurality of terminals arranged in only one stage in the above embodiment, a connector having a plurality of terminals arranged in a plurality of stages can also be realized.

Moreover, although the description has been given of the connector in which the terminals arranged in the same stage have the same shape, a connector in which a plurality of kinds of terminals are arranged in the same stage can also be realized.

Moreover, although the description has been given of the case where the present disclosure is applied to a plug connector, the present disclosure can also be applied to a receptacle connector. Moreover, the present disclosure may be applied to a connector (plug connector or receptacle connector) to electrically connect between. circuit boards or between cables. Furthermore, the present disclosure may be applied to a connector (plug connector or receptacle connector) to electrically connect electric wires to a circuit board or a connector (plug connector or receptacle connector) to electrically connect electric wires to a cable.

Moreover, the specifications (shape, size, layout, and the like) of the housing, the terminals, and the other details may also be changed as needed.

The invention claimed is:

1. An electrical connector, comprising:

a housing; and a terminal held in the housing and to be mounted on a mounting member, wherein the terminal includes a main body part inserted into a space formed in the housing and a mounting part to be mounted on the mounting member, the main body part includes a bottom wall and a side wall provided continuously from an end, in a width direction intersecting with an insertion direction of the main body part into the space, of the bottom wall, the mounting part is provided continuously from a leg part which extends in a top-bottom direction from a rear end of the bottom wall, the top-bottom direction intersecting with the insertion direction and the width direction, a groove which is formed in the space, and in which a tip of the side wall is inserted to guide insertion of the main body part into the space, the space includes an insertion opening opened toward the outside of the housing and an insertion main cavity which communicates with the insertion opening and in which to house the main body part of the terminal, and the groove is formed in the insertion main cavity.

2. The electrical connector according to claim 1, wherein a length of the groove in an insertion direction is not shorter than a distance by which the main body part moves between the start and end of insertion of the tip of the side wall.

3. The electrical connector according to claim 1, wherein the groove extends beyond the center of the space to an inner side of the space in the insertion direction.

4. The electrical connector according to claim 1, wherein the insertion opening has a second groove formed therein to guide insertion of the main body part into the space, and the second groove communicates with the groove.

5. The electrical connector according to claim 1, wherein the side walls are provided continuously from both ends of the bottom wall in the width direction, and one of the side walls has an extension wall formed therein, which protrudes, more than the other side wall, in the insertion direction of the main body part into the space.

* * * * *